United States Patent [19]

Gilbert

[11] 3,977,309

[45] Aug. 31, 1976

[54] OBSERVATION OF MOVING WEBS

[75] Inventor: Victor Henry Gilbert, Isleworth, England

[73] Assignee: Robinson & Sons Limited, Chesterfield, England

[22] Filed: Oct. 7, 1974

[21] Appl. No.: 512,603

[30] Foreign Application Priority Data

Oct. 10, 1973 United Kingdom ..... 47234/73

[52] U.S. Cl. ..... 93/94 R; 93/80; 156/193

[51] Int. Cl.[2] ..... B31C 3/00

[58] Field of Search ..... 93/94 R, 80, 77 R; 83/289; 156/193, 195

[56] References Cited

UNITED STATES PATENTS

| | | | |
|---|---|---|---|
| 3,150,575 | 9/1964 | Couzens et al. | 93/80 |
| 3,330,186 | 7/1967 | Glasby et al. | 93/80 |
| 3,664,239 | 5/1972 | Woelbel | 93/80 |

FOREIGN PATENTS OR APPLICATIONS

| | | | |
|---|---|---|---|
| 1,022,669 | 1/1958 | Germany | 83/289 |

*Primary Examiner*—James F. Coan

*Attorney, Agent, or Firm*—Davis, Hoxie, Faithfull & Hapgood

[57] ABSTRACT

A method for observing a moving web having printed thereon a regularly repeated pattern and control features along the web, comprising mounting two photoelectric cells a fixed distance apart in the direction of movement of the web, the photoelectric cells being adapted simultaneously to scan identical data in different locations on said web, the cells being connected in an electrical circuit which is balanced when they observe identical data and which produces an output when they observe non-identical data due to one cell but not the other observing a control feature.

14 Claims, 3 Drawing Figures

OBSERVATION OF MOVING WEBS

Figure 1:
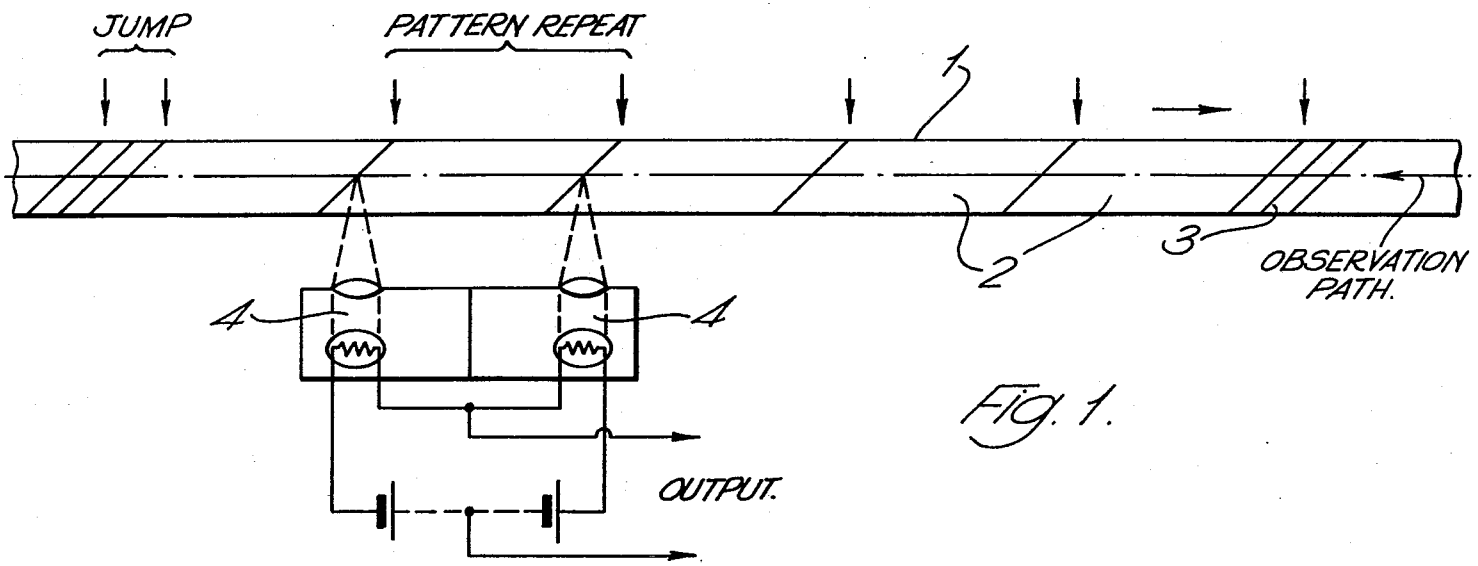

This invention relates to the observation of moving webs, and is especially, athough not exclusively, concerned with the observation of moving printed webs used in the manufacture of spirally wound tubes.

In the manufacture of spirally wound tubes, for example such as cylindrical cardboard tubes which are used for packaging purposes, one or more strips of cardboard or other suitable material are spirally and continuously wrapped in edge to edge and/or overlapping fashion around a mandrel along which the resultant tube is continuously moved. The tube can be overwrapped with an adhesive-coated outer ply or web suitably made of card, paper, metal foil and the like. Irrespective of whether the tube is multi or single ply, one of the ply webs carries a sequence of printed patterns or other data, each pattern being appropriate to an individual container. Individual containers are then cut from the continuously formed tube or subsequently cut from a "stick" containing a multiple of containers, severed from the continuously formed tube. The manufacture of spirally wound tubes is described, inter alia, in U.S. Pat. Nos. Re 23,899, 2,737,091, 3,264,956, 2,734,432, 2,712,778, 2,699,099, 2,623,443, 3,133,483.

It is obviously most important, in a manufacture of this sort, that the printed strip or web which is spirally wound onto the outside of the base tube should be kept in registry with the ends of the containers or stick of containers being cut off, to ensure that each individual container contains a complete set of data. Thus, it is usual to synchronise the movement of the cutting mechanism with the presentation of the printed strip to cut containers or sticks from the composite spirally wound tube. Various methods have been proposed in the past for bringing about this synchronism, and these have usually involved the provision of registration marks or control features on the printed web, observations of which features enabled the speed at which the web is moving and/or the operation of the cutter mechanism to be controlled. Reference is made, for example, to U.S. Pat. No. 3,133,483, which describes the manufacture of spirally wound containers, and also shows methods of obtaining a desired pattern-to-cut relationship. In the past it has been proposed that the control features might be in the form of perforations, registrable with pegs or pins on the periphery of a freely rotatable drum; or in the form of printed control marks provided on the strip and observable by means of a photoelectric cell. It is also well known to provide surplus spaces, known as "trim bands", between adjacent pattern sequences and to cut the continuously formed tube at the positions of some or all trim bands. Printed control marks have been provided at the trim bands.

Great difficulties occur, however, when the patterns or other data printed on the printed web are of a complex or multi-coloured nature (as nowadays is often the case), since it is difficult for the photocell to sort out the control feature from the so-called "mush" of the rest of the pattern. These difficulties have been overcome to a certain extent by printing the control marks on the reverse, i.e. otherwise plain, side of the web. The expense involved in such printing can, however, be great, requiring in any case an extra printing cylinder, and in some cases an extra run through the printing machine. Another solution to this problem has been to make the printed strip wider than otherwise necessary, in order to make provision for a plain track down the underlap edge of the strip adjacent the printed matter, the control marks being printed in the plain track. The provision of such a broad underlap is not unsightly but is uneconomic in terms of material usage and in some cases might cause deckle problems of a physical and/or economic nature.

It is an object of the present invention to provide a method of observing a moving web, and to use such a method in the manufacture of spiral containers which does not involve the difficulties outlined above.

According to the present invention a method for observing a moving web having printed thereon a regularly repeated pattern and control features along the web comprises mounting two photoelectric cells a fixed distance apart in the direction of movement of the web, the photoelectric cells being adapted simultaneously to scan identical data in different locations on said web, the cells being connected in an electrical circuit which is balanced when they observe identical data and which produces an output when they observe non-identical data due to one cell but not the other observing a control feature.

Put another way, the invention proposes the use of two photocells mounted a fixed predetermined distance apart and observing simultaneously, for the most part, identical data in separate individual patterns on the printed web as it passes the cells. The photocells may observe data in adjacent patterns, or in patterns remote from each other. The photocells will be connected into a circuit which is balanced, electrically speaking, when the photocells observe identical data. When, however, the two photocells observe non-identical data, due to one of them observing a pre-determined control feature and the other not, the lack of coincidence in the cell conditions will produce an imbalance in the circuit, with a resultant output therefrom.

This output may be used in various ways in the manufacture of the aforementioned spirally wound containers by way of suitable known circuitry. For instance, it can be fed to the tube cutting mechanism, to initiate a cutting cycle; or it can be fed, again through suitable known circuitry, to a comparator, which compares the timing of the output pulse, for example, with a reference mechanism linked to the drive of the cutting mechanism, in order to ascertain whether or not the moving pattern bearing web is in correct phase relationship with the cutting machine. If it is not, then suitable correction can be instituted; for instance a correction motor can be operated to accelerate or decelerate the speed of movement of the cutting machine.

The control features on the web, which incidentally may be observed before or after it is spirally wound around the being-formed container, may take various forms. All that is in fact required is that from time to time during the movement of the web the two photocells, which for the most part observe simultaneously identical though changing data, should observe non-identical data. This condition may be achieved by means of the use of conventional control marks, i.e. marks printed at spaced intervals along the web, either in the printed matter itself or in the plain track adjacent thereto; or by arranging that an irregularity in the pattern, or a jump in the pattern spacing, occurs at selected positions along the web. The former, as indicated, involves the use of conventional control features. The latter, however, involves the provision along the web of deliberate irregularities. These may take a number of forms. For example, when the web is printed with a repeating pattern involving a number of different colours, the colours in one pattern, or in a small portion of one pattern, may be different from those of adjacent patterns. Again, the detail in one pattern, or in a small portion of one pattern, may be shifted slightly relative to similar detail in adjacent patterns. Thirdly, a trim band may be interposed between certain adjacent patterns at spaced positions along the web. All of these irregularities ensure that at certain positions along the web the two scanning photocells observe different light conditions.

Thus, in the first example one cell observes one colour and the second another colour. In the second example one cell observes one part of the pattern and the second another part. In the third example one cell observes part of the pattern and the second cell observes a trim band or a control feature printed in a trim band. Such different light conditions result in the imbalance referred to above, and the resultant circuit output.

It should be made clear that when we refer herein to a "pattern" we mean that matter which is printed on the printed web and is appropriate to the unitary pattern of a single container ultimately cut from the continuously formed tube. The pattern data may be of an advertising nature, indicating the source and/or identity of the packaged product; or pictorial matter; or any combination of printed matter.

Figure 2:
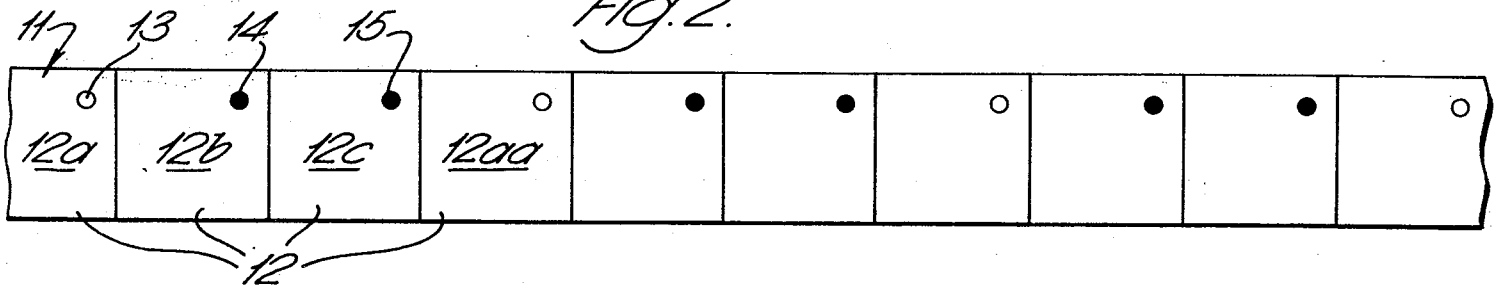
Figure 3:
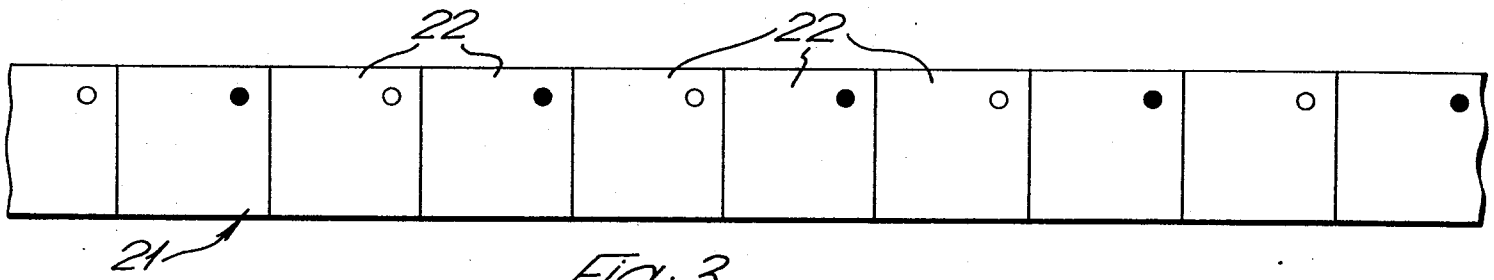

An embodiment of the invention will now be described, by way of example, with reference to the accompanying diagrammatic drawings, in which:

FIG. 1 is a diagram showing the way in which two photocells scan a moving web having a repeated pattern printed thereon, as it moves past them; and FIGS. 2 and 3 are views showing two "sticks" of containers, having different arrangements of control marks.

The basic method of spirally winding a base tube and thereafter spirally winding a printed web on to the outer surface of the tube is described in detail in the U.S. patent specifications referred to above, to which attention is directed.

FIG. 1 shows a web 1 printed with a series of identical patterns 2 and having plain strips or trim bands 3 provided after every five patterns. As shown in FIG. 1, two photocells schematically shown as 4 are arranged, a pattern pitch apart, and scan the web 1 as it moves past them. The cells are connected in opposition in a balanced circuit such that with the same light conditions at any instant of time they will cancel each other out. As will be appreciated, they observe, for the most part, exactly similar light conditions, since they observe identical data in adjacent patterns. However, as a trim band 3 passes one of the photocells 4, that photocell observes the trim band whilst the other photocell observes pattern data. Thus, at this moment in time the photocells will be observing non-identical data, there will be an imbalance in the circuit, and an output pulse will result. This output may be used in an identical fashion to that produced by the construction shown in FIG. 5 of U.S. Pat. No. 3,133,483, and for convenience of explanation it may be considered that the two photocells of FIG. 1 herein are equivalent to the single photocell shown in FIG. 5 of the said U.S. specification.

Thus, the output of the unbalanced circuit may be compared with the comparator represented by the contact plate 86 of FIG. 5 of the said U.S. specification, and operation of a correction motor will ensue, if necessary.

FIGS. 2 and 3 show different ways of providing the irregularity necessary to provide the photocells with different light conditions. Thus, in FIG. 2 a tube or stick 11 has a printed surface wrapper in which, in each series of three adjacent patterns 12, the first 12*a* has a different control mark from the second and third, 12*b* and 12*c* respectively. For example, if each pattern in fact comprises a number of differently coloured representations of fruit, one of the fruits in the first pattern may be a light coloured fruit 13 and the corresponding, i.e. relatively identically positioned, fruits in the second and third patterns may be dark coloured, as shown at 14 and 15 respectively. Thus, when the photocells, set a pattern pitch apart, observe the corresponding fruits 13 and 14 in the first and second patterns, 12*a* and 12*b*, there will be an imbalance in the circuit, but when they observe the corresponding fruits 14 and 15 in the second and third patterns 12*b* and 12*c*, there will be no imbalance. Observation of the corresponding fruits 15 and 13 in the third pattern, 12*c* and the first pattern, 12*aa*, of the next sequence will also produce an imbalance, so that the two outputs will be obtained during the passage of each series of three patterns past the cells, and may be used as desired.

In the scheme shown in FIG. 3, wherein a stick of containers 21, with repeating patterns 22 thereon, the control marks alternate along the stick. Thus, an output, due to circuit imbalance, will be produced every time a pattern passes the photocells. The output may be used to exercise very fine control over the registration of the tube movement with the operation of the cutting mechanism.

While FIGS. 2 and 3 illustrate observation on a patterned tube on the mandrel during winding, equivalent observation for such imbalance can be carried out on the described patterns while the patterned web is moving towards the point of winding.

The manufacture of tubes by spiral winding is described in detail in the following patent specifications U.S. Pat. Re No. 23,899 and U.S. Pat. Nos. 2,623,443, 2,623,445, 2,699,099, 2,712,778, 2,734,432, 2,737,091, 3,133,483, 3,139,011, 3,150,574, 3,150,575, 3,264,956, 3,330,186; U.K. Pat. Nos. 653,613, 653,615, 661,851, 695,194, 703,981, 743,122, 743,115, 743,116, 743,123, 743,170, 953,683, 980,629, 985,793 and 1,031,585; and Canadian Pat. Nos. 524,423, 568,728, 714,809, 744,157 and 760,710. Reference is directed to these specifications for an understanding of the tube manufacturing methods in conjunction with which the observation technique of the present invention may be used.

What we claim is:

1. The steps in a manufacturing process comprising observing a moving web which bears along its length regularly repeated complex variegated patterns, utilizing two fixedly positioned photo-electric cells aligned a fixed distance apart in the direction of movement of the web for concurrently observing the web, causing the photocells simultaneously to scan identical data at different locations along the web, connecting the cells in an electrical circuit which is balanced when they observe identical data and which produces an output when they observe non-identical data, providing non-identical data as a control feature in accordance with a predetermined arrangement, said output being produced by only one of said cells observing a control feature, and utilizing said output to initiate activating mechanism for controlling subsequent use of said patterns in the manufacturing process.

2. A method as claimed in claim 1 wherein said photoelectric cells are mounted so as to observe data in adjacent patterns.

3. A method as claimed in claim 1 wherein the control features are provided by the provision of trim bands, interposed between adjacent patterns at spaced positions along the web.

4. The method as claimed in claim 1 wherein the non-identical data comprises a pattern variation in predetermined adjacent patterns.

5. A method as claimed in claim 1 wherein the control features comprise marks printed at spaced intervals along the web.

6. The method as claimed in claim 1 wherein the non-identical data comprises a color variation in predetermined adjacent patterns.

7. In the process of manufacturing tubular container bodies bearing patterns in register with the ends thereof, comprising the steps of helically winding onto tubing a pattern strip or web bearing along its length regularly repeated complex variegated patterns, utilizing two fixedly positioned photo-electric cells aligned a fixed distance apart in the direction of movement of the moving web for concurrently observing the web, causing the photocells simultaneously to scan identical data at different locations along the moving web, connecting the cells in an electrical circuit which is balanced when they observe identical data and which produces an output when they observe non-identical data, providing non-identical data as a control feature in accordance with a predetermined arrangement, said output being produced by only one of said cells observing a control feature, and utilizing said output to initiate activating mechanism for controlling subsequent use of said patterns in the manufacturing process.

8. A method as claimed in claim 7 wherein said photoelectric cells are mounted so as to observe data in adjacent patterns.

9. A method as claimed in claim 7 wherein the control features comprise marks printed at spaced intervals along the web.

10. The method as claimed in claim 7 wherein the non-identical data comprises a pattern variation in predetermined adjacent patterns.

11. The method as claimed in claim 7 wherein the non-identical data comprises a color variation in predetermined adjacent patterns.

12. In the process claimed in claim 7 the step of initiating cutting of the tubing in response to production of said output.

13. In the process claimed in claim 7 the step of utilizing said output in comparison of the positional progress of the patterns with the condition of cutting mechanism in determination of activation of mechanism for controlling the relationship of said positional progress and the cutting.

14. In the process claimed in claim 7, the step of utilizing said output to initiate mechanism for varying the speed of movement of said web.

* * * * *